US007669648B2

(12) United States Patent
Victor

(10) Patent No.: US 7,669,648 B2
(45) Date of Patent: Mar. 2, 2010

(54) POLYMER SHOCK ABSORBER FOR USE WITH WELL HEAD LUBRICATOR ASSEMBLY

(75) Inventor: Bruce M. Victor, Fort Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 173 days.

(21) Appl. No.: 11/833,640

(22) Filed: Aug. 3, 2007

(65) Prior Publication Data

US 2009/0032243 A1 Feb. 5, 2009

(51) Int. Cl.

| | |
|---|---|
| ***E21B 33/00*** | (2006.01) |
| ***E21B 33/068*** | (2006.01) |
| ***E21B 23/02*** | (2006.01) |
| ***F16F 1/36*** | (2006.01) |

(52) U.S. Cl. ..... 166/70; 166/86.2; 267/153

(58) Field of Classification Search ..... 166/70, 166/86.2, 84.2, 92.1, 153, 310; 267/153
See application file for complete search history.

(56) References Cited

U.S. PATENT DOCUMENTS

| | | | | |
|---|---|---|---|---|
| 3,147,808 | A * | 9/1964 | Mccarvell et al. | 166/70 |
| 3,806,106 | A | 4/1974 | Hamel et al. | |
| 4,198,037 | A | 4/1980 | Anderson | |
| 4,475,722 | A | 10/1984 | Paton et al. | |
| 4,962,916 | A | 10/1990 | Palinkas | |
| 5,052,665 | A | 10/1991 | Sakuragi | |
| 5,280,890 | A | 1/1994 | Wydra | |
| 5,327,596 | A | 7/1994 | Wallace et al. | |
| 5,460,357 | A * | 10/1995 | Stewart | 267/294 |
| 5,467,970 | A | 11/1995 | Ratu et al. | |
| 5,868,384 | A * | 2/1999 | Anderson | 267/141.1 |
| 5,957,441 | A | 9/1999 | Tews | |
| 6,250,617 | B1 | 6/2001 | Tews | |
| 6,571,868 | B2 * | 6/2003 | Victor | 166/70 |

* cited by examiner

*Primary Examiner*—Jennifer H Gay
*Assistant Examiner*—Michael Wills, III
(74) *Attorney, Agent, or Firm*—Aileen Law; A Law Firm, P.C.

(57) ABSTRACT

A shock absorber for use with a lubricator assembly comprises a body made substantially of a polymer material. An end of the body is supportable by a cup. Upon plunger strike, the cup can travel upward in the lubricator assembly and cause the polymer body to deform and dissipate a force of impact caused by the plunger. The body can resiliently compress and expand to substantially an original form. Equalization slots on the body can enable fluid carried to the surface by a plunger to flow from the lubricator assembly.

16 Claims, 4 Drawing Sheets

POLYMER SHOCK ABSORBER FOR USE WITH WELL HEAD LUBRICATOR ASSEMBLY

FIELD OF ART

The disclosed device relates generally to a lubricator assembly employed at a well head of a gas-producing well, and more specifically to a lubricator cap assembly employing a polymer shock absorber to absorb and dissipate a force of impact caused by a traveling plunger.

BACKGROUND

In general operation, well liquids are carried out of well tubing by high velocity gas. However, liquids can start to fall back to the bottom of a well as the well declines. This can result in production decreases because well liquids are not carried to the surface. In addition, the liquid fall back can exert back pressure on the formation, which can "load up" the well. Inflow from the formation is impeded as average flowing bottom hole pressure increases. As a hydrocarbon well is cycled between shut-in and opened conditions, a plunger lift system disposed within the tubing of the well and capable of traveling vertically in the tubing can provide a method for unloading fluids whereby production can be increased and/or optimized with minimal interruption to production.

In a typical plunger lift system, a plunger can freely travel to the bottom of the well where it may be used to help push liquids to the surface where it is collected. The plunger is adapted to rise vertically under the force of sufficient gas pressure to drive or lift the plunger and a slug of liquid, such as oil, above it to the surface or well head while isolating the base of the liquid slug from the gas which lifts the plunger. The mechanical interface created by the plunger between any accumulated liquids and gas helps to prevent liquid fallback. Not only can plunger lift help in boosting a well's lifting efficiency, the afore-mentioned back pressure can be relieved, which helps to increase inflow from the formation. A plunger can also help keep the well tubing free of paraffin, salt and/or scale build-up. After the liquids that are carried by the plunger are delivered to the surface, and the pressure of gas flowing from the well tubing has decreased below the force of gravity on the plunger, the plunger falls by gravity back down the tubing of the well for another cycle. When the plunger hits the bottom or contacts fluid in the well, gas pressure that has been allowed to build under the plunger will cause the plunger to rise again with any accumulated fluid.

Such gas-producing wells also typically employ a lubricator assembly mounted at the well head in communication with the upper end of the well tubing. The various functions of the lubricator assembly may be to 1) catch the plunger when it arrives at the well head, 2) provide an external mount for a sensor capable of detecting an arrival of the plunger at the lubricator and sending a signal to an electronic controller at the well head, and 3) allow access to the plunger, i.e., when maintenance is required.

Conventional lubricator assemblies typically comprise an elongated metal coil spring disposed in an interior chamber of a tubular lubricator body between an upper end cap and a lower strike plate. The metal coil spring is intended to function to absorb the high impact forces generated by the leading end of the arriving plunger on the strike plate and thereby protect the rest of the structure of the lubricator assembly. In the event of a collapse and failure of the metal coil spring, the plunger can break up and get stuck in the lubricator's tubular body as the plunger strikes the end cap of the lubricator assembly substantially with full force. Collapse and failure of the steel coil spring results in a required shutdown of the well to make the necessary repair and/or replacement of damaged components. U.S. Pat. No. 6,571,868 to Victor discloses a lubricator assembly for a well head of a gas-producing well comprising an elongated polymer body having a cylindrical configuration that can be resiliently compressed along its longitudinal axis and that can spring back to substantially its original form.

Under certain operating conditions and for various reasons, the problem of premature failure of the tubular body has been experienced. During a plunger strike against the end cap of the lubricator assembly, the failure of the body housing the polymer shock absorber not only causes the plunger to break up and get stuck in the tubular body, but can result in the shattering of the tubular body itself whereby all types of high velocity debris are thrown out from the impact. The damage leads to a required shutdown of the well to make the necessary repair and/or replacement of damaged components and to an increased risk of bodily harm or injury. In additional, the damage could lead to unintentional releases of liquid petroleum hydrocarbon into the environment.

Consequently, a need exists for an innovation in the lubricator assembly employed at the well head of a gas-producing well which will provide a solution to the aforementioned problem.

SUMMARY OF THE DISCLOSURE

The disclosed device provides an improved lubricator assembly comprising a polymer shock absorber capable of withstanding the impact forces generated by extremely high plunger speeds without failure compared to the conventional metal coil spring which can collapse and fail under the same conditions. The shock absorber comprises an elongated body made substantially of a polymer material, an end of said body supportable by a cup. The shock absorber can comprise a spring rod along its longitudinal axis capable of supporting the elongated body to resiliently compress along the longitudinal axis and spring back to substantially an original form of the elongated body. The disclosed device can also comprise equalization slots that enable fluid carried to the surface by a plunger to flow from the lubricator assembly.

These and other advantages of the disclosed device will appear from the following description and/or appended claims, reference being made to the accompanying drawings that form a part of this specification wherein like reference characters designate corresponding parts in the several views.

Before explaining the disclosed embodiments of the disclosed device in detail, it is to be understood that the device is not limited in its application to the details of the particular arrangements shown, since the device is capable of other embodiments. Also, the terminology used herein is for the purpose of description and not of limitation.

DESCRIPTION OF THE DISCLOSED FIGURES

The following description is provided to enable any person skilled in the art to make and use the disclosed apparatus. Various modifications, however, will remain readily apparent to those skilled in the art, since the generic principles of the present apparatus have been defined herein specifically to provide for a device capable of controlling the force of impact or shock transmitted by a traveling plunger.

Figure 1:
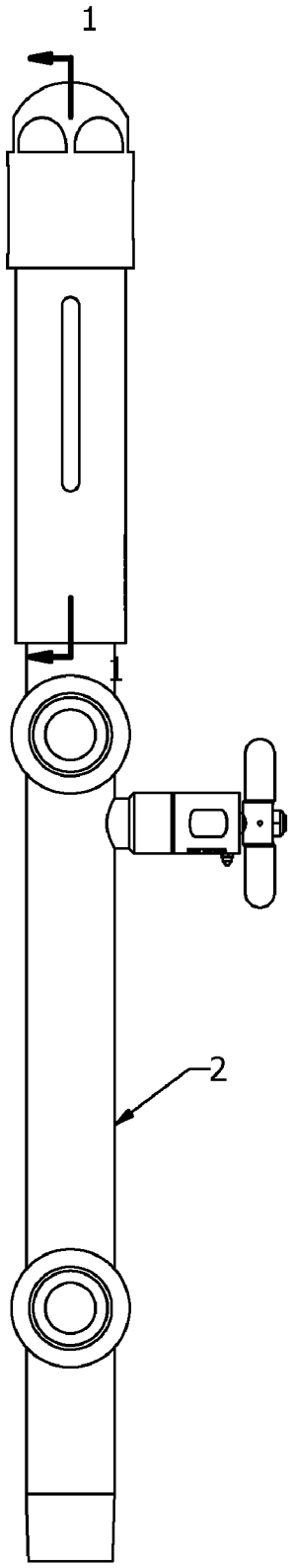
FIG. 1 (PRIOR ART)
FIG. 1 (prior art) is a side elevational view of a lubricator assembly of a gas-producing well having a prior art lubricator cap assembly mounted thereon and shown in longitudinal section form.
Figure 2:
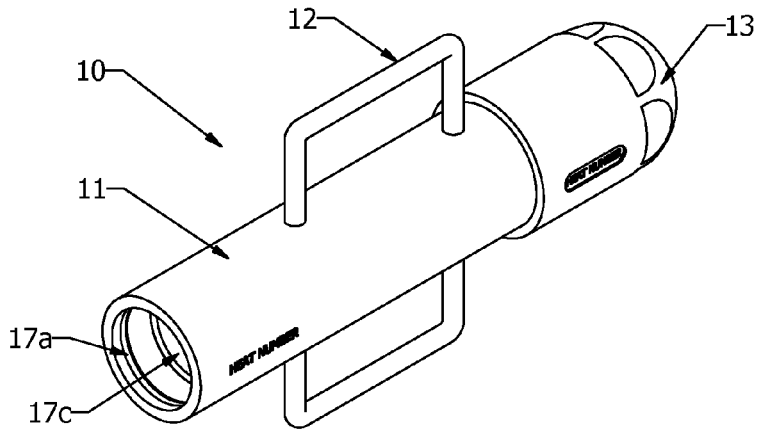
FIG. 2 is a perspective view of one embodiment of the lubricator cap assembly disclosed herein.

FIGS. 1, 2 show a conventional lubricator cap assembly 1 mounted on a lubricator body assembly 2 of a gas-producing well. Lubricator cap assembly 1 comprises an elongated rigid tubular body 3 defining an interior chamber 4 of a substantially cylindrical configuration, an end cap 5 removably mounted on and closing an upper end portion 3*a* of the tubular body 3, a strike plate 6 disposed in the interior chamber 4 at a lower end portion 3*b* of the tubular body 3, and an elongated coil spring 7 disposed in the interior chamber 4 of the tubular body 3 between the upper end cap 5 and lower strike plate 6. Coil spring 7 is made of a suitable metal, such as conventional steel, and is intended to function to absorb the high impact forces generated by the leading end of the arriving plunger on strike plate 6 and thereby protect the rest of the structure of lubricator cap assembly 1. As the leading end of a plunger (not shown) collides with strike plate 6, steel spring coil 7 absorbs the impact of the arrival of the plunger.

Figure 3:
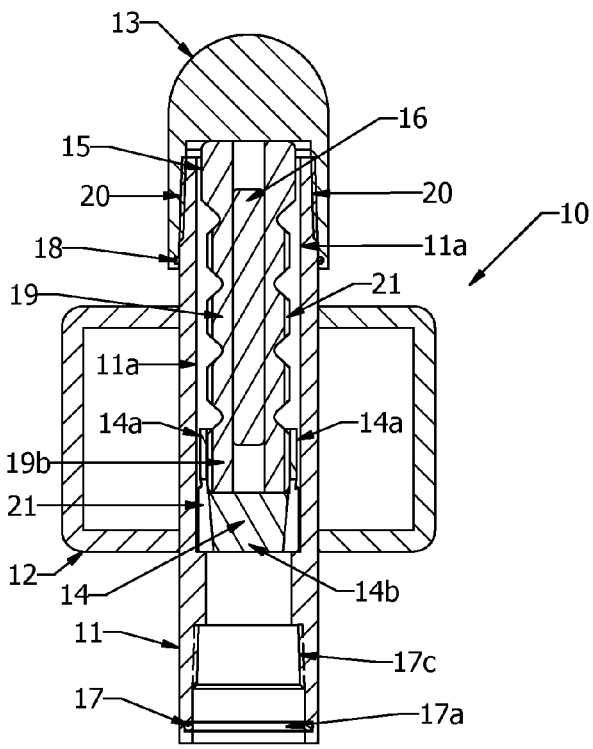
FIG. 3 is a sectional view along line 3-3 showing the shock absorber of a lubricator cap assembly embodiment in an uncompressed mode.
Figure 4:
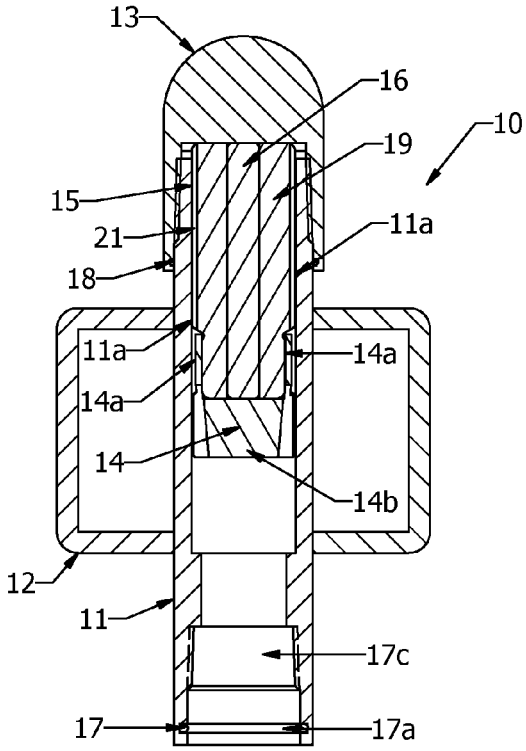
FIG. 4 is a sectional view along line 4-4 showing the shock absorber of a lubricator cap assembly embodiment in a compressed mode.

FIGS. 2, 3, 4 depict one embodiment of the lubricator cap assembly 10 disclosed herein, wherein generally a polymer impact-absorbing assembly 15 may reside in a housing 11 in place of the conventional steel coil spring 7 of FIG. 1. Housing 11 comprises handle 12 for operator maneuverability or ease of use. Lubricator cap assembly 10 can be mounted to a lubricator body assembly by threads 17*c* or other known means. An o-ring 17 and groove 17*a* combination, can be used if desired to provide a mechanical seal. Although the embodiments disclosed herein comprise O-rings formed of fluoroelastomer, namely Viton®, those having skill in the art will recognize that an o-ring will be selected based on chemical compatibility, sealing pressure, lubrication requirements, quality, cost, etc. In addition, any other suitable seal means could be employed. Lubricator cap assembly 10 comprises a removable end cap 13.

Figure 1A:
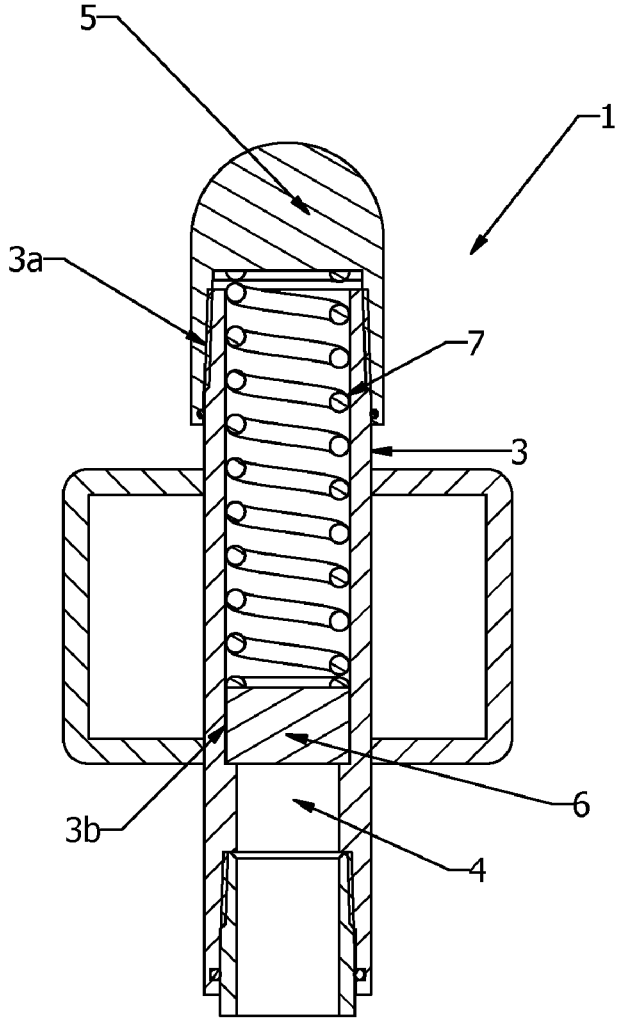
FIG. 1A (PRIOR ART)
FIG. 1A (prior art) is a sectional view along line 1-1 showing the spring of a prior art lubricator cap assembly.

As shown, shock absorber assembly 15 of lubricator cap assembly 10 comprises a substantially elongated body 19 having an end supportable in a cup 14. Body 19 comprises a polymer material capable of resiliently compressing and springing back to substantially an original form. An upper portion 14*a* of cup 14 serves to provide a supporting enclosure for end 19*b*. Shock absorber assembly 15 can be disposed in housing 11 in generally the same position as the steel coil spring 7 it replaces. As stated above, the leading end of a plunger (not shown) collides with strike plate 6 causing steel spring coil 7 to absorb the impact of the arrival of the plunger through compression. See FIGS. 1, 1A. However, where spring 7 resides between removable end cap 3 and strike plate 6 of lubricator cap assembly 1 of a prior art device, shock absorber assembly 15 of the disclosed device can be simply disposed adjacent removable end cap 13. With the disclosed device, the leading end of a plunger (not shown) can strike a lower portion of end 14*b* of cup 14. As the impact of the plunger displaces the cup in an upward direction, body 19 deforms to absorb the impact of the arrival of the plunger as shown in FIG. 4. To reach a compressed mode, shock absorber assembly 15 can travel upwardly toward removable end cap 13 and outwardly toward inner walls 11*a* of housing 11.

As stated above, body 19 deforms to absorb the impact transmitted by a plunger that has traveled to the lubricator assembly. Although body 19 operates like a typical spring to store energy from the plunger's movements, it also acts as a shock absorber to damp mechanical or physical shock and dissipate kinetic energy. A variety of polymer materials can be utilized to produce a spring/damper shock absorber. For example, one embodiment of the disclosed device contemplates the use of black polymer having an A-scale Shore value in the range of about 90+/−5. In conjunction with a die casting process, the disclosed device can be devised depending on the desired application. Those having skill in the art will recognize that the various parameters of a body 19 of the shock absorber assembly 15, i.e. length, diameter, color and Shore value, etc. will be engineered according to the particular application and shock to be absorbed. For example, an elastomer or rubber could be chosen. In general, the disclosed device contemplates the use of any polymer or rather, any organic non-metallic structure, or combination thereof. In addition, dies capable of producing other shapes that those depicted herein as well as other fabrication methods could be utilized.

As stated above body 19 comprises an end supportable in a cup 14. Although cup 14 can be formed from a low carbon steel that can undergo case hardening and/or cold forming processes, any suitable material or method of manufacture can be used. As one example, stainless steel could be employed if desired.

In this embodiment, shock absorber assembly 15 can also comprise a spring rod 16 capable of supporting body 19 to resiliently compress and spring back to substantially an original form. When shock absorber assembly 15 reaches a compressed mode as shown in FIG. 4, spring rod 16 may abut removable end cap 13. End cap 13 can be mounted to body 11 by threads 20 or other known means. Although the spring rod of the disclosed embodiment comprises stainless steel, any suitable material or construction could be employed. A seal 18, e.g., an o-ring and groove combination, can be used if desired in conjunction with a mounting of end cap 13; however, any other suitable sealing means can also be employed.

Figure 3A:
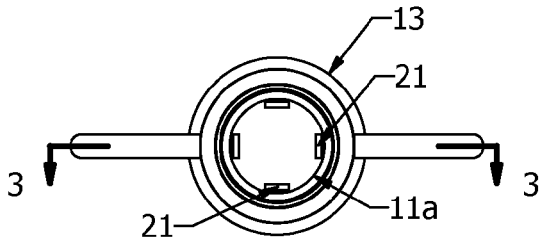
FIGS. 3A, 4A are end views of the device shown in FIG. 2
Figure 4A:
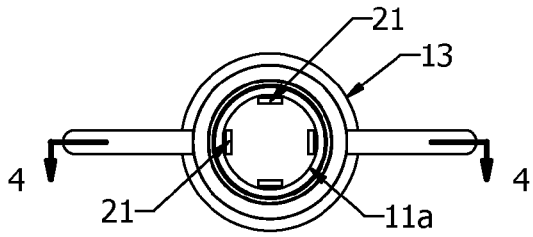

Typically, accumulated fluid in the lubricator cap assembly will result in a decreased ability of the shock absorber to absorb plunger impacts. The disclosed device can also comprise equalization slots that enable fluid carried to the surface by a plunger to flow from the lubricator cap assembly. Here, shock absorber assembly 15 can comprise one or more slots 21 capable of allowing fluid drainage. See also FIGS. 3A, 4A. In a compressed mode, one or more slots 21 could align one with another to form one or more channels to enable fluid to pass therethrough.

Figure 5:
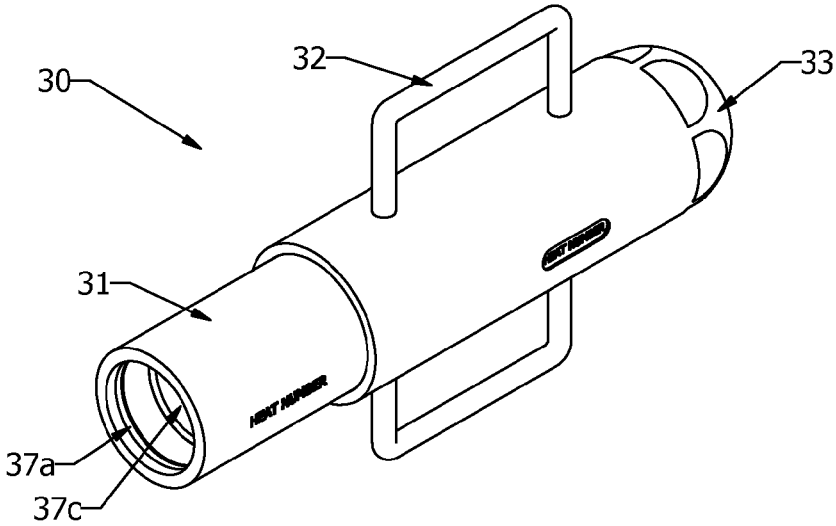
FIG. 5 is a perspective view of an alternate embodiment of the lubricator cap assembly disclosed herein.

The embodiment of FIG. 5 operates in a basic manner as that of FIG. 2. Lubricator cap assembly 30 can be mounted to a lubricator body assembly by threads 37*c* or other known means. An o-ring 37 and groove 37*a* combination, can be used if desired to provide a seal, however, any other suitable sealing means can be employed.

Figure 6:
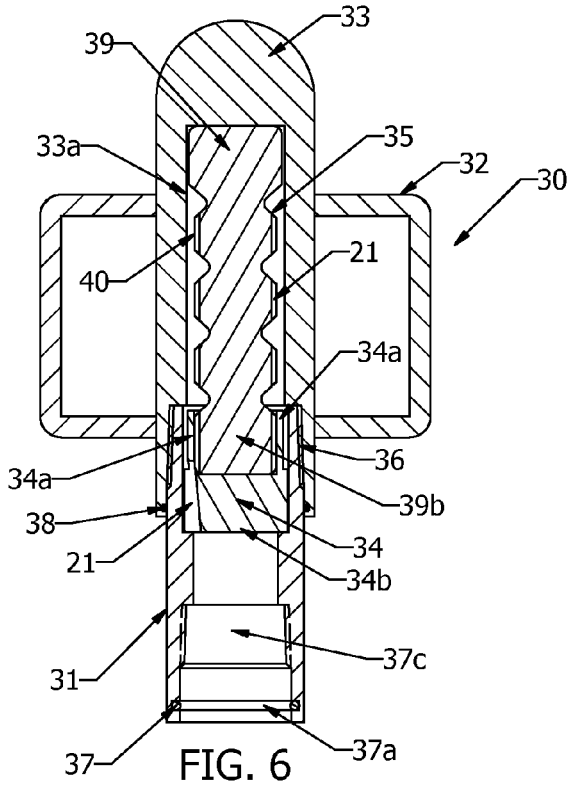
FIG. 6 is a sectional view along line 6-6 showing the shock absorber of a lubricator cap assembly embodiment in an uncompressed mode.

In this embodiment, lubricator assembly 30 comprises an end cap 33 having a handle 32. See also FIG. 6. End cap 33 comprises an impact-absorbing assembly 35 mounted in a housing 31. Housing 31 can be mounted to end cap 33 by threads 36 or other known means. A seal 38, e.g., an o-ring and groove combination, can be used if desired in conjunction with a mounting of end cap 33; any other suitable sealing means can also be employed.

Figure 7:
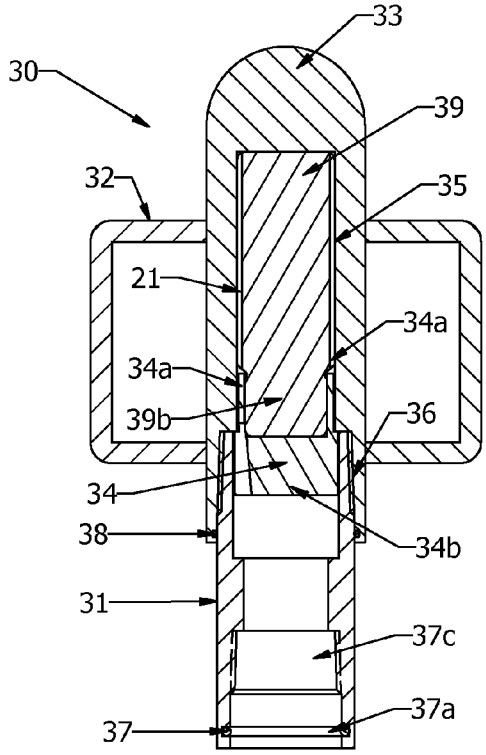
FIG. 7 is a sectional view along line 7-7 showing the shock absorber of a lubricator cap assembly embodiment in a compressed mode.
Figure 6A:
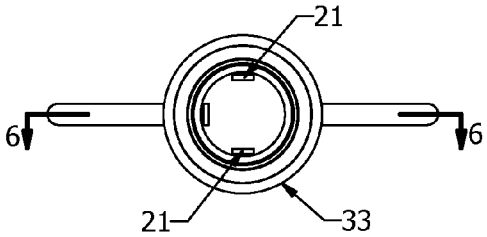
FIGS. 6A, 7A are end views of the device shown in FIG. 5
Figure 7A:
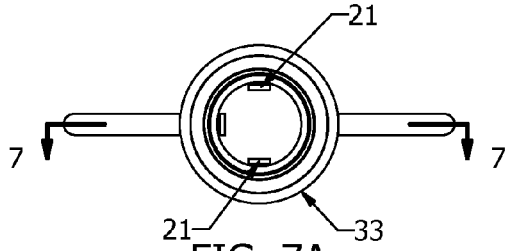

Body 39 comprising a polymer material capable of resiliently compressing and springing back to substantially an original form is shown supportable in a cup 34. An upper portion 34*a* of cup 34 serves to provide a supporting enclosure for end 39*b*. Shock absorber assembly 35 can be disposed adjacent removable end cap 33. As the leading end of a plunger (not shown) strikes a lower portion end 34*b* of cup 34, the impact of the plunger displaces the cup in an upward direction. Body 39 deforms to absorb the impact of the arrival of the plunger as shown in FIG. 7. To reach a compressed mode, shock absorber assembly 35 can travel upwardly toward removable end cap 33 and outwardly toward inner walls 33*a*.

This embodiment can also comprise equalization slots that enable fluid carried to the surface by a plunger to flow from the lubricator assembly. Here, shock absorber assembly 35 can comprise one or more slots 40 capable of allowing fluid drainage. In a compressed mode, one or more slots 40 could align one with another to form one or more channels to enable fluid to pass therethrough.

Although the disclosed device and method have been described with reference to disclosed embodiments, numerous modifications and variations can be made and still the result will come within the spirit and scope of the disclosure. No limitation with respect to the specific embodiments disclosed herein is intended or should be inferred.

I claim:

1. A lubricator cap assembly for use at a well head of a gas-producing well, said assembly comprising:

a housing having an upper and a lower end, said lower end capable of receiving an end of a traveling plunger;

a shock absorber assembly mountable in said housing;

said shock absorber assembly comprising a polymer body having an end supportable in a cup, said polymer body comprises one or more slots capable of enabling fluid drainage; and said cup capable of traveling toward said upper end of said housing upon a plunger strike of said cup, thereby causing said polymer body to deform and dissipate a force of impact caused by the plunger.

2. The assembly of claim 1, wherein said plunger strike of said cup causes a radial movement of said polymer body, said radial movement bounded by an inner wall of said housing.

3. The assembly of claim 1, wherein said housing further comprises a cap.

4. The assembly of claim 1, wherein said housing further comprises a handle.

5. The assembly of claim 1, wherein said one or more slots are alignable one with another to form one or more channels to enable fluid to pass therethrough.

6. The assembly of claim 1, wherein said polymer body further comprises a rod along its longitudinal axis capable of supporting said polymer body upon compression along the longitudinal axis and expansion to substantially an original form of said polymer body.

7. A lubricator cap assembly mounted at a well head in communication with an upper end of a well tubing, said apparatus comprising:

a polymer shock absorber comprising an elongated body supportable by a cup;

said shock absorber capable of being mounted in a housing;

said shock absorber further comprising one or more slots capable of enabling fluid drainage;

a lower end of said housing capable of receiving an end of a traveling plunger; and wherein said plunger end can strike a lower portion of said cup, thereby causing an upward travel of said cup and a deformation of said shock absorber to occur.

8. The apparatus of claim 7, wherein an outer length of said shock absorber moves to contact an inner length of said housing during said deformation.

9. The apparatus of claim 7, wherein said housing further comprises a handle.

10. The apparatus of claim 7, wherein said one or more slots are alignable one with another to form one or more channels to enable fluid to pass therethrough.

11. The apparatus of claim 7, wherein said shock absorber expands to substantially an original form.

12. A well head lubricator cap assembly comprising:

an elongated body made substantially of a polymer material and comprising one or more slots capable of enabling fluid drainage, a lower end of said body supportable by a cup;

said body capable of being mounted in a housing, an upper end of said housing comprising a removable cap;

a lower end of said housing capable of receiving an end of a traveling plunger;

wherein said plunger end can strike a lower portion of said cup, thereby causing a travel of said cup toward said removable cap; and wherein said body can deform to absorb a force of plunger impact.

13. The apparatus of claim 12, wherein said deformation further comprises a travel of an outer diameter of said body toward an inner wall of said housing.

14. The apparatus of claim 12, wherein said body further comprises a rod capable of supporting said body.

15. The apparatus of claim 12, wherein said housing further comprises a handle.

16. The apparatus of claim 12, wherein said one or more slots are alignable one with another to form one or more channels to enable fluid to pass therethrough.

* * * * *